US005855381A

United States Patent [19]

Kirk

[11] Patent Number: 5,855,381

[45] Date of Patent: Jan. 5, 1999

[54] WHEEL LOCK FOR IN-LINE SKATES

[76] Inventor: Norbert Kirk, 1458 W. Belle Plaine, Chicago, Ill. 60613

[21] Appl. No.: 245,213

[22] Filed: May 17, 1994

[51] Int. Cl.[6] ..... A63C 17/14

[52] U.S. Cl. ..... 280/112

[58] Field of Search ..... 280/11.2, 11.22, 280/11.23, 11.21, 825; 188/1.12, 24.12, 31, 265; 301/5.3; 70/233, 226, 227

[56] References Cited

U.S. PATENT DOCUMENTS

| | | | |
|---|---|---|---|
| 416,846 | 12/1889 | Messinger | 188/31 |
| 692,538 | 2/1902 | Niemeyer | 70/226 |
| 3,652,103 | 3/1972 | Higgs | 188/1.12 |
| 3,900,203 | 8/1975 | Kukulowicz | 280/11.2 |
| 4,084,663 | 4/1978 | Haley | 188/31 |
| 4,199,043 | 4/1980 | Lankester et al. | 188/31 |
| 4,622,833 | 11/1986 | Shepherd | 70/226 |
| 4,833,442 | 5/1989 | Von Heck | 70/226 |
| 4,932,676 | 6/1990 | Klamer | 280/11.21 |
| 5,133,201 | 7/1992 | LaMott et al. | 188/265 |
| 5,232,071 | 8/1993 | Kawanabe | 188/1.12 |
| 5,275,030 | 1/1994 | Cole | 70/227 |
| 5,310,250 | 5/1994 | Gonsior | 301/5.3 |
| 5,411,320 | 5/1995 | Alderman et al. | 301/5.3 |

*Primary Examiner*—Richard M. Camby
*Attorney, Agent, or Firm*—Laff, Whitesel, Conte & Saret, Ltd.

[57] ABSTRACT

A locking device for restricting rotation of at least one wheel of an in-line skate of the type having a two-sided frame for rotatably mounting the wheels therebetween. The device includes a generally elongated member for releasably engaging at least one wheel of the skate and the frame to prevent rotation of the wheel within the frame. The elongated member extends through at least one hole in the wheel and is oriented transversely to the linear arrangement of the wheels and parallel to their rotational axes.

3 Claims, 8 Drawing Sheets

WHEEL LOCK FOR IN-LINE SKATES

FIELD OF THE INVENTION

This invention relates to wheel locks. More particularly, this invention relates to wheel locks which prevent rotation of at least one wheel of an in-line skate.

BACKGROUND OF THE INVENTION

In-line skates typically include a boot for receiving a foot, a frame mounted to the bottom of the boot, and a series of wheels, usually composed of urethane, rotatably mounted in a row within the frame. During recent years, skating on in-line skates has become increasingly popular both recreationally and commercially. For example, in-line skating is often substituted for jogging, walking, bicycling, and aerobic exercise. In addition, employees in large warehouses and of messenger services is sometimes use in-line skates to increase their speed and efficiency. However, despite its growing popularity, there are various problems associated with in-line skating, as described below.

The predominant problem with in-line skating is the injuries sustained from falls. Such injuries most often occur when the skater encounters inclines, curbs, stairs or other surfaces (such as grass) where skating is not practical, or when the skater improperly uses the skates indoors. In each instance, the injuries are generally attributable to the skater's loss of balance caused by the undesired rotation of the wheels within the skate frame. To avoid these problems, skaters often remove the skates from their feet and carrying the skates when confronted with problem surfaces. Unfortunately, skate removal is often not practical, particularly for city messengers who typically hand-carry deliveries and have no effective means to transport the skates during nonuse. In other cases, the skaters simply disregard the dangers and attempt to cross the problem surfaces as best they can.

Thus, in an effort to minimize at least one potential area of injury, in-line skating poles have been introduced to assist skaters on inclines. Such poles are comparable in length to ski poles and are typically quite heavy. While these poles may offer some protection against fall-related injuries, they are cumbersome and inconvenient to carry around. In addition, the in-line skating poles are relatively expensive.

Another recent development in skating safety is a skate brake located adjacent the rear of the skate. The skate brake is dragged along the ground to frictionally immobilize the wheels of a moving skate. The brake is activated into a braking position by flexing the skater's leg. Likewise, the brake is automatically released from a braking position by flexing the leg again. Thus, while the skate brake is useful in some situations for stopping a moving skater, the wheels do not remain fixed once the skater resumes movement, and consequently the brake only offers temporary immobilization of the skate wheels. The skater cannot rely on the brake to navigate the problem surfaces described above.

In addition, transformer boots are available which enable skates to be converted into boots for walking. While the transformer boots provide a means for skaters to walk in skates, they are expensive and cumbersome to transport.

Accordingly, an object of this invention is to provide a locking device for restricting the rotation of at least one wheel of an in-line skate, so as to enable a skater to walk up or down inclines or stairs, over curbs, across grass or indoor surfaces.

Another object of the invention is to provide a locking device for an in-line skate which fits existing skates.

Another object of the invention is to provide a locking device for an in-line skate which is easily stored during nonuse.

Yet another object of the present invention is to provide a locking device for an in-line skate which is relatively inexpensive to manufacture.

SUMMARY OF THE INVENTION

The present invention, in a preferred embodiment, accomplishes the foregoing objects by providing a locking device for restricting rotation of at least one wheel of an in-line skate. The locking device includes a generally elongated member which extends through at least one hole in the wheel of the skate to prevent rotation of the wheel within the skate frame.

In a preferred embodiment, the elongated member includes an arcuately shaped grip piece with three integrally formed and evenly spaced arms which project from the grip piece in parallel relation to one another. The grip piece is arcuately shaped so that the arms are correspondingly spaced relative to the circular configuration of holes in a typical spoked wheel.

In another embodiment, the elongated member includes a substantially flat grip piece with a pair of integrally formed arms which are spaced apart and which also project from the grip piece in parallel relation to one another. Instead of being arcuately shaped, the top and bottom surfaces of the elongated member are flat and in parallel planes. The arms extend through spoke holes in a single wheel. In yet another embodiment, the substantially flat grip piece includes two pairs of integrally formed arms which correspond to and releasably engage spoke holes in two wheels of the in-line skate.

In each of the above embodiments, the arms preferably include means adjacent one end for lockably securing the elongated members to the skate frame.

In yet another embodiment, the elongated member includes a grip piece with an integrally formed cylindrical portion which is partially threaded for increasing friction and limiting movement of the cylindrical portion within the wheel hole. The cylindrical portion extends through a hole drilled into the "tire" portion of the wheel. In addition, the cylindrical portion extends through opposing holes located on both sides of the skate frame, which holes are aligned with the hole in the tire portion.

The above, as well as other objects and advantages of the invention, will become apparent from the following detailed description of the preferred embodiment, reference being made to the accompanying drawings.

DETAILED DESCRIPTION OF THE INVENTION

Generally referring to FIGS. 1–17, the invention provides a locking device, denoted by the numeral 20, for eliminating rotation of at least one wheel of an in-line skate. By eliminating rotation of at least one wheel, a skater can easily walk across a surface which would be difficult or unsafe to skate across. Locking device 20 includes a generally elongated member 22(A–D) which extends perpendicularly through at least one hole in the wheel of the skate to prevent rotation of the wheel within the skate frame.

Figure 1:
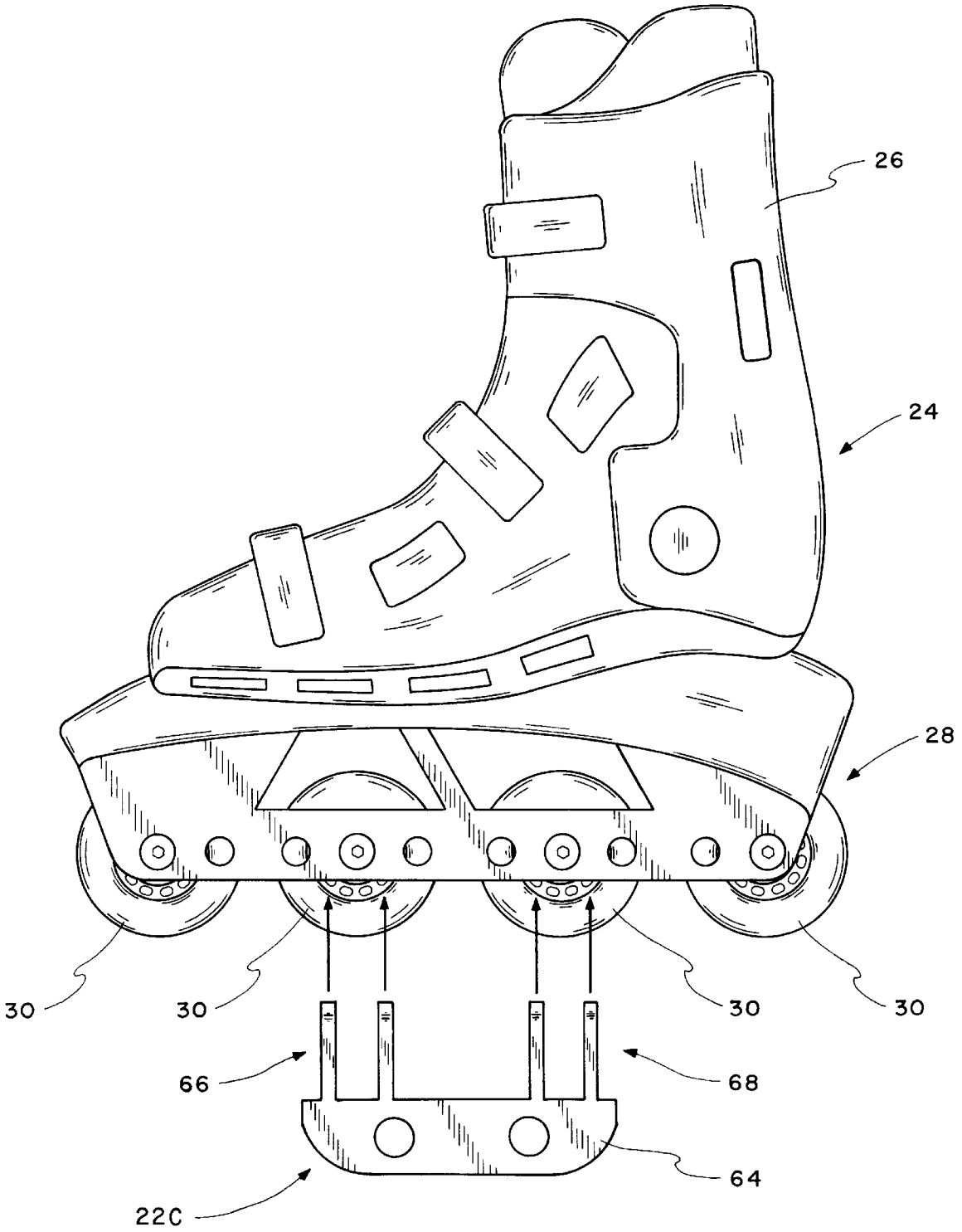
FIG. 1 is a side view of an in-line skate, illustrating the insertion of one embodiment of the inventive locking device into the wheels of the skate.
Figure 2:
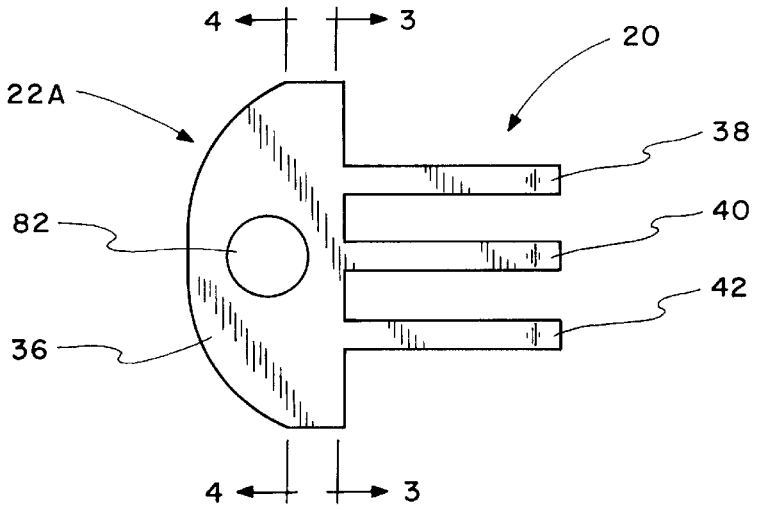
FIG. 2 is a top plan view of the preferred embodiment of the locking device.
Figure 3:
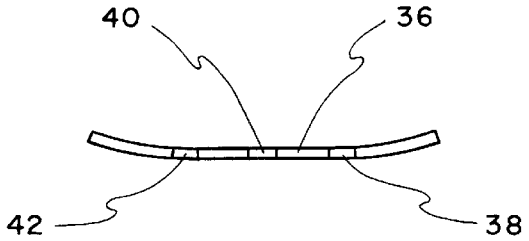
FIG. 3 is a cross-sectional view of the locking device, taken along lines 3—3 of FIG. 2.
Figure 4:
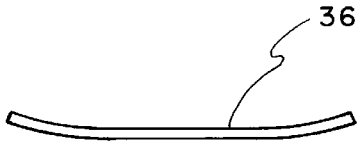
FIG. 4 is a cross-sectional view of the locking device, taken along lines 4—4 of FIG. 2.

FIG. 1 shows a conventional in-line skate 24 which includes a boot portion 26 with an integrally attached two-sided frame 28 for mounting at least four wheels 30 by any conventional means. A plurality of evenly spaced holes 32 are disposed adjacent the lower edge 34 of each side of frame 28, which are usually used for mounting the wheels. The locking devices described in each of the embodiments below prevent the rotation of one or more wheels within the skate frame.

Figure 5:
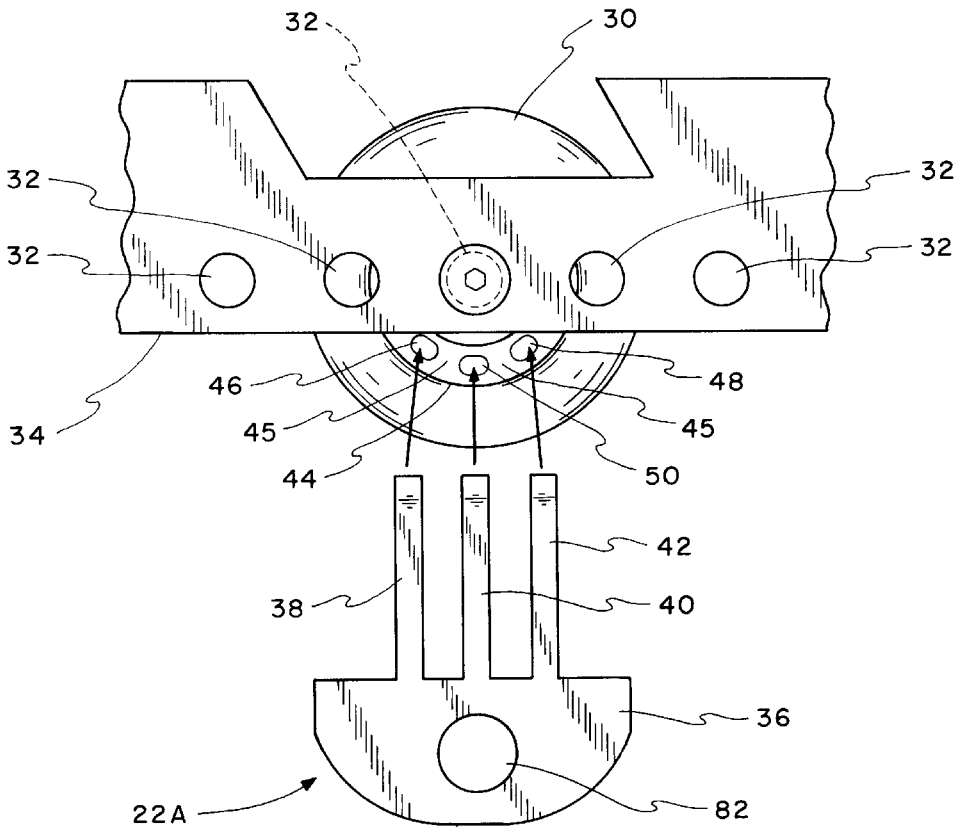
FIG. 5 is a partial side view of the skate frame and mounted wheel, illustrating the insertion of the locking device of FIG. 2 into the wheel.
Figure 6:
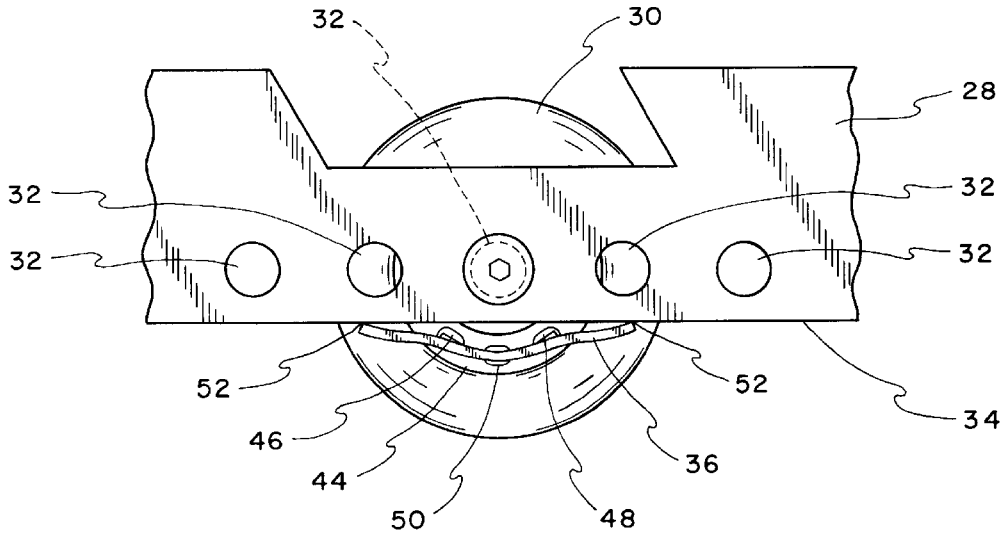
FIG. 6 is a partial side view of the skate frame and mounted wheel, illustrating the appearance of the locking device of FIG. 2 subsequent to its insertion into the wheel.
Figure 7:
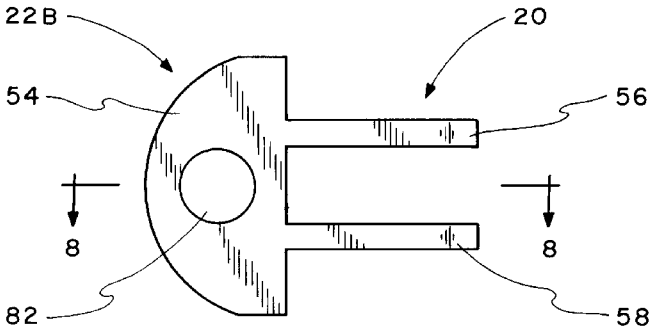
FIG. 7 is a top plan view of an alternate embodiment of the locking device.

Referring to FIGS. 2–6, in a preferred embodiment, elongated member 22A includes an arcuately shaped grip piece 36 with three integrally formed and evenly spaced arms 38, 40, 42 which project is from grip piece 36 in parallel relation to one another. Arms 38, 40, 42 extend through adjacent holes disposed along the perimeter of the wheel hub 44 between spokes 45. Specifically, arms 38, 42 (the outer arms) extend through the two holes 46, 48 most proximate to lower edge 34 of the skate frame. In contrast, arm 40 (located in the middle) extends through a hole 50 in between the holes 46, 48 and provides additional stability to the locking device. Because grip piece 36 is arcuately shaped, arms 38, 40, 42 are arcuately disposed to correspond to the circular configuration of the holes in the wheel hub. In addition, the arcuate shape of grip piece 36 causes its outside edges 52 to abut against and securely engage lower edge 34 on one side of the skate frame (FIG. 6). This arrangement prohibits rotation of the wheel.

FIGS. 7–10, 12, and 17 show another embodiment, wherein elongated member 22B includes a substantially flat grip piece 54 with a pair of integrally formed arms 56, 58 which are spaced apart and project from grip piece 54 in parallel relation to one another. The spacing between the arms depends on the distance between the spoke holes and may vary in different skates. Arms 56, 58 extend through selected, non-adjacent holes 60, 62 disposed along the perimeter of the wheel hub. Holes 60, 62 are immediately adjacent lower edge 34 of the frame 28. Thus, when member 22B is properly inserted into holes 60, 62, arms 56, 58 abut against and tightly engage lower edges 34 of frame 28 on both sides of the frame.

Figure 17:
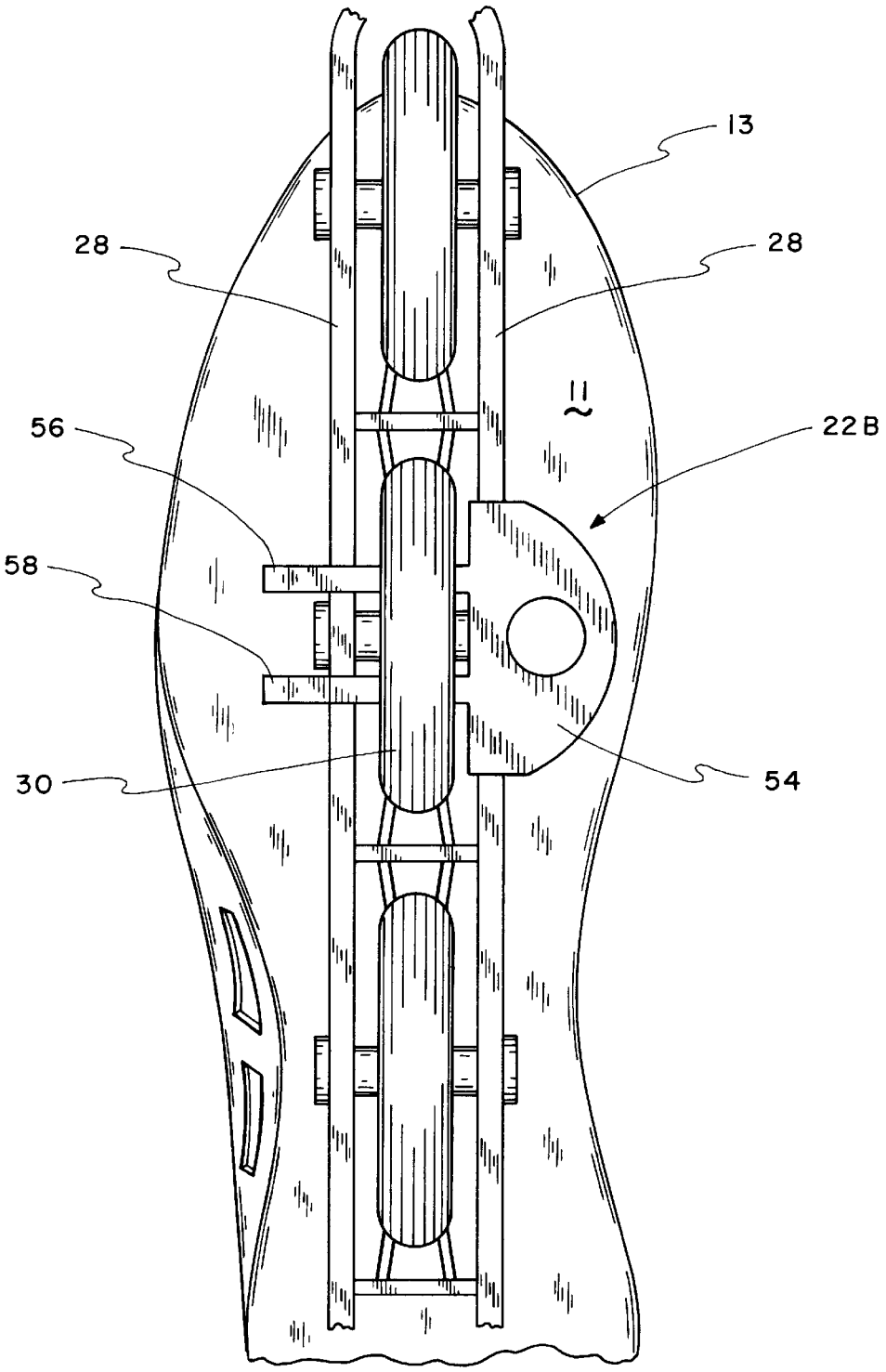
FIG. 17 is a partial plan view of the underside of an in-line skate, showing the embodiment of FIG. 7 lockingly inserted in a wheel.

In FIG. 17, elongated member 22B is shown inserted through wheel 30. Arms 56, 58 extend between and across frame sides 28 which are mounted to the underside 11 of boot 13. Grip piece 54 and arms 56, 58 frictionally engage frame sides 28.

Figure 11:
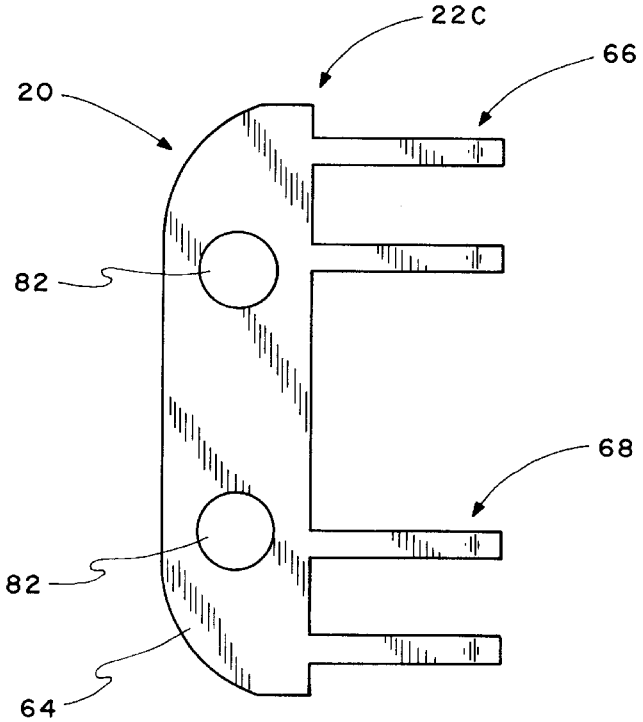
FIG. 11 is a top plan view of another alternate embodiment of the locking device.
Figure 12:
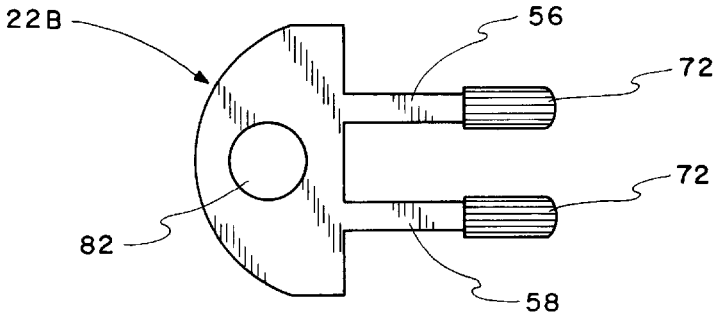
FIG. 12 is a top plan view of the locking device of FIG. 7, illustrating the placement of caps on the ends of the arms.
Figure 13:
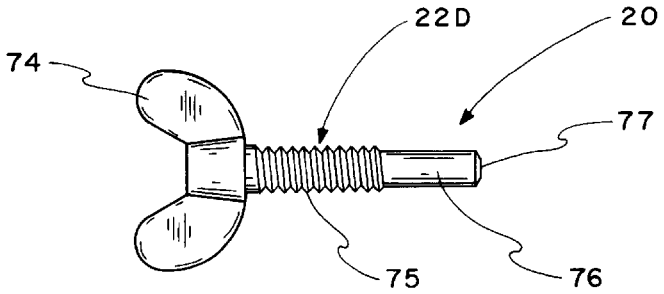
FIG. 13 is a top plan view of yet another alternate embodiment of the locking device.
Figure 14:
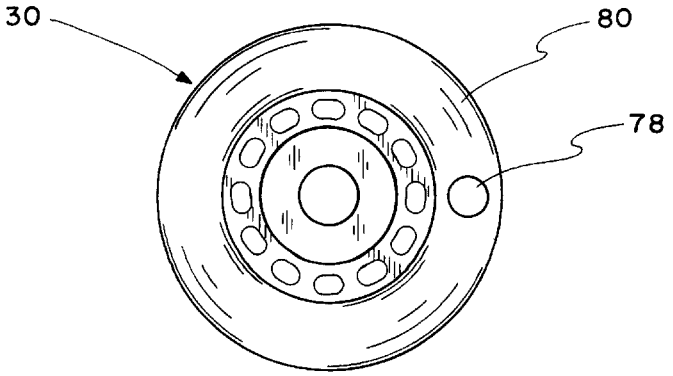
FIG. 14 is a side view of a skate wheel, illustrating the location of the drilled hole in the tire portion of the wheel.
Figure 15:
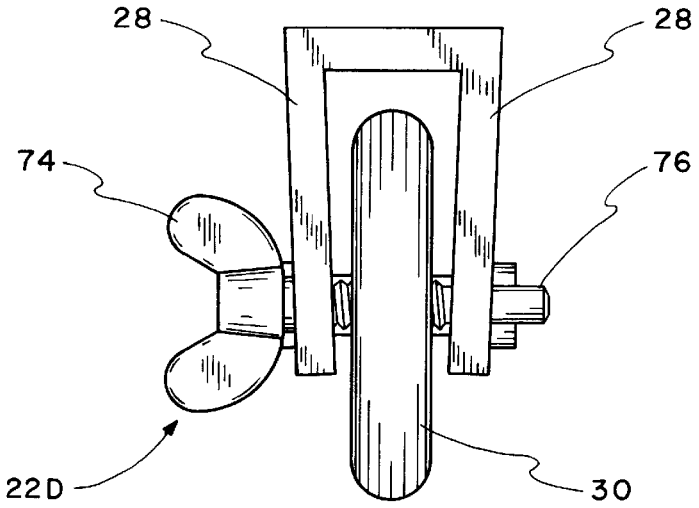
FIG. 15 is a cross-sectional view of the skate frame and mounted wheel, illustrating the appearance of the locking device of FIG. 13 subsequent to its insertion into the wheel.
Figure 16:
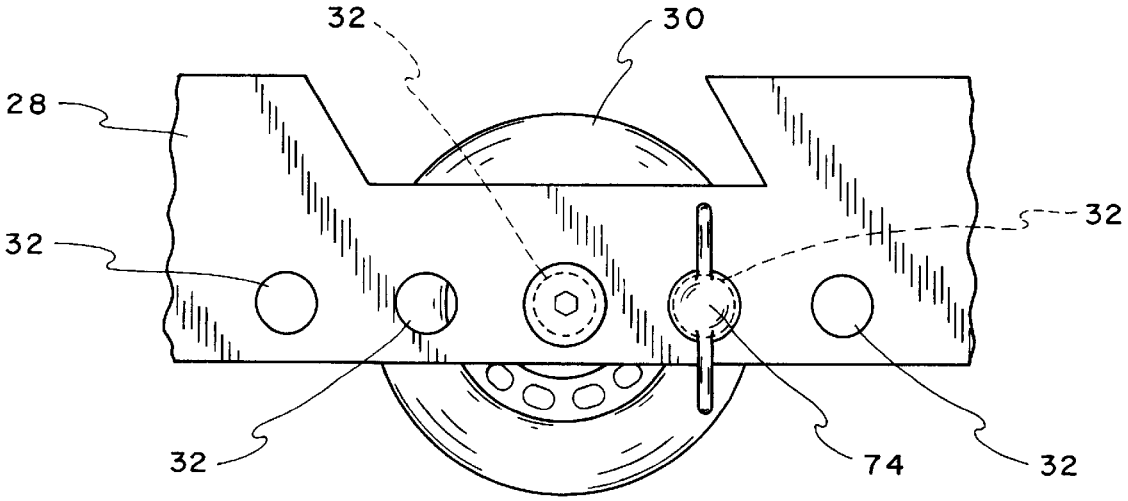
FIG. 16 is a partial side view of the skate frame and mounted wheel, illustrating the insertion of the locking device of FIG. 13 into the frame and wheel.

In an alternate embodiment shown in FIGS. 1, 11, grip piece 64 of elongated member 22C includes two pairs of integrally formed arms 66, 68 which correspond to and releasably engage two preferably adjacent wheels of the in-line skate, as shown in FIG. 1 (see also FIG. 11). Arms 66, 68 extend through holes in the wheels and engage the skate frame in a manner similar to that described in relation to the above embodiment. The two pairs of arms increase the stability of locking device 20 by eliminating rotation of two wheels, as compared to the previous embodiment which shows a single pair of arms and elimination of rotation of a single wheel.

Figure 8:
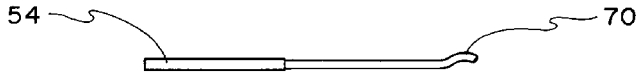
FIG. 8 is a side view of the locking device, taken along lines 8—8 of FIG. 7.

In each of the embodiments described above, the arms preferably include protuberances 70 (FIGS. 8, 10), caps 72 (FIG. 12), or other prominent means adjacent their distal ends remote from the grip piece which firmly engage one side of the frame and resist lateral movement of the elongated members, thereby lockably securing the arms within the wheel(s). Protuberances 70 are preferably integral with the arms and may be formed by any means, including by bending the arms adjacent their distal ends into v-shapes (FIG. 8). Caps 72 may be rubber pieces for frictionally engaging the arms.

Figure 9:
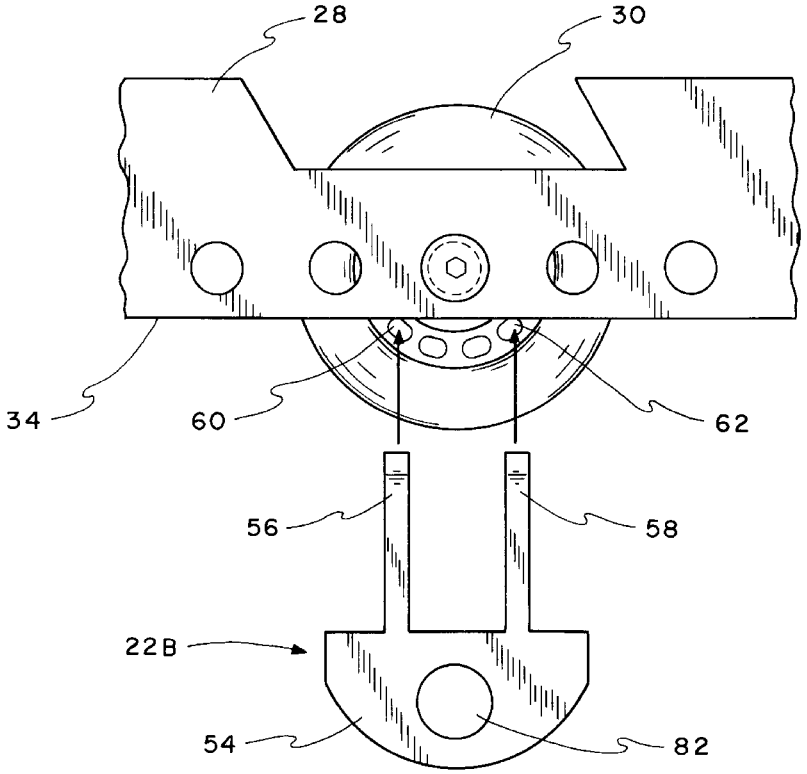
FIG. 9 is a partial side view of the skate frame and wheel, illustrating the insertion of the locking device of FIG. 7 into the wheel.
Figure 10:
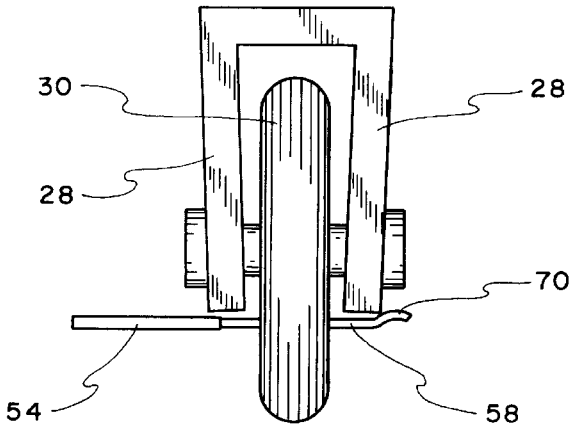
FIG. 10 is a cross-sectional view of the skate frame and mounted wheel, illustrating the appearance of the locking device of FIG. 7 subsequent to its insertion into the wheel.

In use, the user holds the grip piece of elongated members 22A–C in each of the three above embodiments and inserts the arms into the holes of one or more wheels of the in-line skate (FIGS. 1, 5, 9). The arms are preferably inserted into the middle wheels of the skate—and not the two outside wheels—so that each of the arms (FIG. 10) or the opposite sides of the grip piece (FIG. 6) abut(s) against the skate frame. Furthermore, the arms are inserted into the holes of the wheel hub which are in closest proximity to the skate frame. In each instance, the arms are inserted through the holes until they project from the opposite side of the wheel hub and across both sides of frame 28.

Protuberances 70 or caps 72 (the latter applied after insertion through the wheel hub) abut against the skate frame.

In yet another embodiment, elongated member 22D includes a grip piece 74 with an integrally formed cylindrical portion or arm 76 having threads 75 along at least part of its length. (FIGS. 13–16). Cylindrical portion 76 extends through both the wheel and sides of the frame 28. Specifically, cylindrical portion 76 extends through a hole 78 drilled into the tire portion 80 of the wheel and also through opposing holes 32 located on each side of skate frame 28. In this embodiment, the user aligns the hole in the tire with the holes on each side of the frame. The user then holds grip piece 74 and threads cylindrical portion 76 into the aligned holes. Cylindrical portion 76 is threaded into the holes until the end 77 projects from the hole on the opposite side of the skate frame. The threads 75 remain within the tire portion 80 and frictionally engage it to reduce inadvertent lateral movement of the elongated member 22D. Once inserted, cylindrical portion 76 prevents movement of the wheel within the frame.

Locking device 20 may be stored beneath the strap of the boot, in a pocket, strapped around a wrist, or hung around the user's neck with a chain or string. Additionally, locking device 20 is preferably made of spring steel in the embodiments that show arms but may alternatively be made of heavy gauge wire. In the last-described embodiment, locking device 20 is preferably made of rigid plastic. Locking device 20 has not been described in terms of approximate measurements, as it should be understood that the size of the locking device may vary according to skate construction and wheel size.

Thus, the inventive locking device restricts rotation of one or more wheels of an in-line skate so that the user may walk on the skates without the rolling motion which occurs during skating. Moreover, the locking device enables the user to walk on inclines, stairs, curbs, and even wear the skates indoors without fear of injury. The locking device is small enough that the user may store it under a strap of the skate boot, in a pocket, on a wrist, or around the neck.

There are additional benefits and advantages particularly inherent in the first three described embodiments. It is estimated that locking device 20 may be stamped out at a rate of at least 30 pieces per minute and is easily rack packaged. Moreover, locking device 20 preferably includes at least one opening 82 in the grip piece for suspending the device from a chain and also for minimizing the weight of the device. Locking device 20 may also function as an L-wrench (not shown) by lengthening one of the arms in the previously described embodiment wherein elongated member 22 includes a single pair of arms.

Those who are skilled in the art will readily perceive how to modify the invention. Therefore, the appended claims are to be construed to cover all equivalent structures which fall within the true scope and spirit of the invention.

The invention claimed is:

1. An in-line skate and separable locking device for restricting rotation of at least one wheel of an in-line skate of the type having a plurality of wheels, each wheel with circularly arranged holes therein, said skate also having a two-sided frame for mounting the wheels therebetween, said locking device comprising a generally elongated member which releasably engages said at least one wheel of the skate to prevent rotation of said at least one wheel within the frame, said elongated member having a grip piece with at least two spaced and parallel arms which project from said grip piece, said grip piece arcuately shaped so that said arms align with and extend through said at least two circularly arranged holes in said at least one wheel, whereby the locking device is coupled to the skate in order to immobilize at least one wheel.

2. An in-line skate and separable locking device of claim 1 wherein said frame has holes located on each side of the frame, said frame holes being aligned with holes in the wheel, said arm of sufficient length to extend simultaneously through both sides of said frame and a wheel therebetween when said arms amp inserted through them.

3. An in-line skate and separable locking device for restricting rotation of at least one wheel of an in-line skate of the type wherein a plurality of wheels, each wheel with circularly arranged holes therein, are aligned linearly within a frame, said locking device comprising a grip piece and three spaced arms extending from said grip piece in parallel relation to one another, said grip piece arcuately shaped so that said arms are also arcuately disposed to align with and to insert through said circularly arranged holes in said at least one wheel so as to engage said frame.

* * * * *